US008733448B2

(12) United States Patent
Skinner et al.

(10) Patent No.: US 8,733,448 B2
(45) Date of Patent: May 27, 2014

(54) ELECTRICALLY OPERATED ISOLATION VALVE

(75) Inventors: Neal G. Skinner, Lewisville, TX (US); Ricardo R. Maldonado, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 149 days.

(21) Appl. No.: 13/046,730

(22) Filed: Mar. 12, 2011

(65) Prior Publication Data

US 2011/0232917 A1 Sep. 29, 2011

(30) Foreign Application Priority Data

Mar. 25, 2010 (WO) ..... PCT/US2010/028576

(51) Int. Cl.
*E21B 34/06* (2006.01)

(52) U.S. Cl.
USPC ..... 166/373; 166/66.6; 166/318

(58) Field of Classification Search
USPC ..... 166/373, 66.6, 66.7, 318, 332.4; 137/487.4; 251/25, 26, 30.01–30.05
See application file for complete search history.

(56) References Cited

U.S. PATENT DOCUMENTS 2,912,216 A 11/1959 Conrad
3,500,952 A * 3/1970 Beeken ..... 181/123
4,312,404 A 1/1982 Morrow
4,531,580 A 7/1985 Jones
4,574,889 A 3/1986 Pringle
4,606,416 A 8/1986 Knighton et al.
4,698,631 A * 10/1987 Kelly et al. ..... 340/853.1
4,768,594 A * 9/1988 Akkerman ..... 166/319
5,127,477 A * 7/1992 Schultz ..... 166/336

(Continued)

FOREIGN PATENT DOCUMENTS

WO 0118357 A2 3/2001
WO 2008120025 A2 10/2008

OTHER PUBLICATIONS

International Search Report and Written Opinion issued Jan. 20, 2011 for International Patent Application Serial No. PCT/US2010/28574, 10 pages.

(Continued)

*Primary Examiner* — Blake Michener
(74) *Attorney, Agent, or Firm* — Smith IP Services, P.C.

(57) ABSTRACT

A method of operating an isolation valve can include transmitting a signal to a detector section of the isolation valve, and a control system of the isolation valve operating an actuator of the isolation valve in response to detection of the signal by the detector section. An isolation valve can include a detector section which detects a presence of an object in the isolation valve, and a control system which operates an actuator of the isolation valve in response to an object presence indication received from the detector section. A well system can include an isolation valve which selectively permits and prevents fluid communication between sections of a wellbore, the isolation valve including a detector section which detects a signal, and the isolation valve further including a control system which operates an actuator of the isolation valve in response to detection of the signal by the detector section.

58 Claims, 10 Drawing Sheets

(56) References Cited

U.S. PATENT DOCUMENTS

| | | | | |
|---|---|---|---|---|
| 5,238,070 | A * | 8/1993 | Schultz et al. | 166/386 |
| 5,249,630 | A | 10/1993 | Meaders et al. | |
| 5,531,270 | A | 7/1996 | Fletcher | |
| 5,819,853 | A | 10/1998 | Patel | |
| 5,971,072 | A * | 10/1999 | Huber et al. | 166/297 |
| 6,017,198 | A * | 1/2000 | Traylor et al. | 417/390 |
| 6,041,864 | A * | 3/2000 | Patel et al. | 166/332.4 |
| 6,142,226 | A | 11/2000 | Vick | |
| 6,152,232 | A | 11/2000 | Webb et al. | |
| 6,167,974 | B1 | 1/2001 | Webb | |
| 6,199,629 | B1 | 3/2001 | Shirk et al. | |
| 6,209,663 | B1 * | 4/2001 | Hosie | 175/57 |
| 6,227,299 | B1 | 5/2001 | Dennistoun | |
| 6,298,767 | B1 * | 10/2001 | Porter | 91/4 R |
| 6,328,109 | B1 | 12/2001 | Pringle et al. | |
| 6,343,649 | B1 | 2/2002 | Beck et al. | |
| 6,343,658 | B2 | 2/2002 | Webb | |
| 6,359,569 | B2 * | 3/2002 | Beck et al. | 340/856.3 |
| 6,419,022 | B1 | 7/2002 | Jernigan et al. | |
| 6,557,637 | B1 | 5/2003 | Dore et al. | |
| 6,619,388 | B2 * | 9/2003 | Dietz et al. | 166/66.7 |
| 6,684,950 | B2 | 2/2004 | Patel | |
| 6,719,057 | B2 | 4/2004 | Johansen | |
| 6,851,481 | B2 * | 2/2005 | Vinegar et al. | 166/374 |
| 6,874,361 | B1 | 4/2005 | Meltz et al. | |
| 6,957,703 | B2 | 10/2005 | Trott et al. | |
| 6,962,215 | B2 | 11/2005 | Curtis et al. | |
| 6,988,556 | B2 | 1/2006 | Vick, Jr. | |
| 7,152,688 | B2 | 12/2006 | Richards | |
| 7,178,600 | B2 | 2/2007 | Luke et al. | |
| 7,255,173 | B2 | 8/2007 | Hosie et al. | |
| 7,273,102 | B2 | 9/2007 | Sheffield | |
| 7,451,809 | B2 | 11/2008 | Noske et al. | |
| 7,475,732 | B2 | 1/2009 | Hosie et al. | |
| 7,487,837 | B2 | 2/2009 | Bailey et al. | |
| 7,503,398 | B2 * | 3/2009 | LoGiudice et al. | 166/386 |
| 7,562,712 | B2 | 7/2009 | Cho et al. | |
| 7,597,151 | B2 | 10/2009 | Curtis et al. | |
| 7,614,454 | B2 * | 11/2009 | Buyers et al. | 166/386 |
| 7,621,336 | B2 | 11/2009 | Badalamenti et al. | |
| 7,665,527 | B2 * | 2/2010 | Loretz | 166/373 |
| 7,673,689 | B2 | 3/2010 | Jackson et al. | |
| 7,789,156 | B2 | 9/2010 | Pia | |
| 7,798,229 | B2 | 9/2010 | Vick, Jr. et al. | |
| 2001/0013411 | A1 * | 8/2001 | Beck et al. | 166/65.1 |
| 2003/0019622 | A1 | 1/2003 | Goodson et al. | |
| 2003/0029611 | A1 * | 2/2003 | Owens | 166/250.03 |
| 2003/0098157 | A1 | 5/2003 | Hales et al. | |
| 2003/0131986 | A1 * | 7/2003 | Schultz et al. | 166/66.5 |
| 2003/0155131 | A1 | 8/2003 | Vick, Jr. | |
| 2003/0192695 | A1 * | 10/2003 | Dillenbeck et al. | 166/285 |
| 2004/0129424 | A1 | 7/2004 | Hosie et al. | |
| 2004/0251032 | A1 | 12/2004 | Luke et al. | |
| 2004/0256113 | A1 * | 12/2004 | LoGiudice et al. | 166/381 |
| 2005/0039921 | A1 * | 2/2005 | Schultz et al. | 166/313 |
| 2005/0194182 | A1 | 9/2005 | Rodney et al. | |
| 2005/0230118 | A1 | 10/2005 | Noske et al. | |
| 2006/0124318 | A1 | 6/2006 | Sheffield | |
| 2006/0144622 | A1 | 7/2006 | Bailey et al. | |
| 2006/0157255 | A1 | 7/2006 | Smith | |
| 2006/0191681 | A1 * | 8/2006 | Storm et al. | 166/250.01 |
| 2007/0012457 | A1 | 1/2007 | Curtis et al. | |
| 2007/0012459 | A1 * | 1/2007 | Buyers et al. | 166/386 |
| 2007/0034371 | A1 | 2/2007 | Moyes | |
| 2007/0295504 | A1 | 12/2007 | Patel | |
| 2008/0078553 | A1 | 4/2008 | George | |
| 2008/0135235 | A1 | 6/2008 | McCalvin | |
| 2009/0050373 | A1 * | 2/2009 | Loretz | 175/59 |
| 2009/0133879 | A1 | 5/2009 | Wright et al. | |
| 2009/0272539 | A1 | 11/2009 | Lloyd et al. | |
| 2010/0163309 | A1 * | 7/2010 | Head | 175/55 |
| 2010/0212891 | A1 | 8/2010 | Stewart et al. | |
| 2011/0232916 | A1 | 9/2011 | Maldonado | |
| 2011/0232917 | A1 | 9/2011 | Skinner et al. | |
| 2011/0240299 | A1 * | 10/2011 | Vick et al. | 166/321 |
| 2012/0234558 | A1 * | 9/2012 | Godfrey et al. | 166/374 |
| 2013/0000922 | A1 | 1/2013 | Skinner et al. | |

OTHER PUBLICATIONS

International Search Report and Written Opinion issued Mar. 17, 2011 for International Patent Application Serial No. PCT/US2010/28576, 10 pages.

Office Action issued Aug. 8, 2011 for U.S. Appl. No. 13/046,728, 10 pages.

International Search Report with Written Opinion issued Sep. 28, 2011 for PCT Patent Application No. PCT/US2011/029116, 9 pages.

International Search Report with Written Opinion issued Feb. 28, 2012 for PCT Patent Application No. PCT/US2011/042836, 9 pages.

Office Action issued Mar. 15, 2012 for U.S. Appl. No. 13/046,728, 10 pages.

Office Action issued Nov. 7, 2012 for U.S. Appl. No. 13/490,936, 14 pages.

Frank Hartly; "Isolate Reservoirs During Underbalanced Operations", Offshore Magazine article, vol. 62, Issue 6, dated 2012, 3 pages.

Halliburton; "Quick-Trip Valve", product overview extracted from www.halliburton.com, dated 2013, 1 page.

Weatherford; "DDV Downhole Deployment Valve Answers Challenge of Drilling Underbalanced Exploration Well from Slant Rig", Weatherford article No. 4861.01, dated 2007-2009, 1 page.

Weatherford; "Well Control without Swab and Surge Effects: The DDV Downhole Deployment Valve", Weatherford article No. 4889.00, dated 2008, 4 pages.

Office Action issued Apr. 15, 2013 for U.S. Appl. No. 13/490,936, 38 pages.

International Preliminary Report on Patentability and Written Opinion issued Jan. 24, 2008 for International Patent Application No. PCT/US06/023947, 6 pages.

PES; "Model DV Dual Control Line Operated Drill Through Lubricator Valve", company document, dated Jul. 27, 2001, 6 pages.

Weatherford, "A Year of Milestones for Your Company", annual report, dated 2002, 7 pages.

Office Action issued Mar. 1, 2007 for U.S. Appl. No. 11/180,140, 9 pages.

Office Action issued Sep. 17, 2007 for U.S. Appl. No. 11/180,140, 8 pages.

Office Action issued Sep. 9, 2008 for U.S. Appl. No. 11/180,140, 12 pages.

Office Action issued Oct. 27, 2008 for U.S. Appl. No. 11/180,140, 11 pages.

Office Action issued Feb. 26, 2008 for U.S. Appl. No. 11/180,140, 7 pages.

Halliburton; "Quick Trip Valve", article H02856R, dated Apr. 2002, 2 pages.

Weatherford; "Underbalanced Drilling: Undeniable Success", product article, dated Mar. 2002, 1 page.

Weatherford; "Products and Services Catalog", brochure # 01.01, dated 2002, 3 pages.

International Preliminary Report on Patentability issued Jan. 24, 2008 for PCT Patent Application No. PCT/US2006/023947, 6 pages.

Weatherford; "DDV: Downhole Deployment Valve", Article No. 335.01, dated 2005-2010, 4 pages.

Weatherford; "Managed Pressure Drilling, Downhole Deployment Valve Enable Drilling of Big-Bore Gas Wells in Sumatra", Article No. 2831.03, dated 2007-2010, 2 pages.

Halliburton; "Capilarry Deliquification Safety System", H06034, dated Jan. 2011, 2 pages.

Halliburton; "DepthStare® Tubing-Retrievable Safety Valve", H06191, dated May 2008, 4 pages.

Halliburton; "Tubing-Retrievable Subsurface Safety Valves", product presentation, dated Jul. 2008, 27 pages.

Halliburton; "DepthStare® Tubing-Retrievable Safety Valve", product presentation, dated Nov. 2009, 9 pages.

International Search Report with Written Opinion issued Aug. 19, 2011 for PCT Patent Application No. PCT/US10/057540, 11 pages.

(56) References Cited

OTHER PUBLICATIONS

Office Action issued Feb. 7, 2013 for U.S. Appl. No. 13/046,730, 20 pages.
Office Action issued Aug. 28, 2013 for U.S. Appl. No. 13/490,936, 10 pages.
Office Action issued Aug. 28, 2013 for U.S. Appl. No. 13/046,728, 40 pages.
Office Action issued Nov. 15, 2013 for U.S. Appl. No. 13/490,936, 15 pages.

* cited by examiner

ELECTRICALLY OPERATED ISOLATION VALVE

CROSS-REFERENCE TO RELATED APPLICATION

This application claims the benefit under 35 USC §119 of the filing date of International Application Serial No. PCT/US10/28576, filed Mar. 25, 2010. The entire disclosure of this prior application is incorporated herein by this reference.

BACKGROUND

The present disclosure relates generally to equipment utilized and operations performed in conjunction with a subterranean well and, in an embodiment described herein, more particularly provides an electrically operated isolation valve.

It is frequently desirable to isolate a lower section of a wellbore from pressure in an upper section of the wellbore. For example, in managed pressure drilling or underbalanced drilling, it is important to maintain precise control over bottomhole pressure. In order to maintain this precise control over bottomhole pressure, an isolation valve disposed between the upper and lower sections of the wellbore may be closed while a drill string is tripped into and out of the wellbore.

In completion operations, it may be desirable at times to isolate a completed section of a wellbore, for example, to prevent loss of completion fluids, to prevent damage to a production zone, etc.

DETAILED DESCRIPTION

Figure 1:
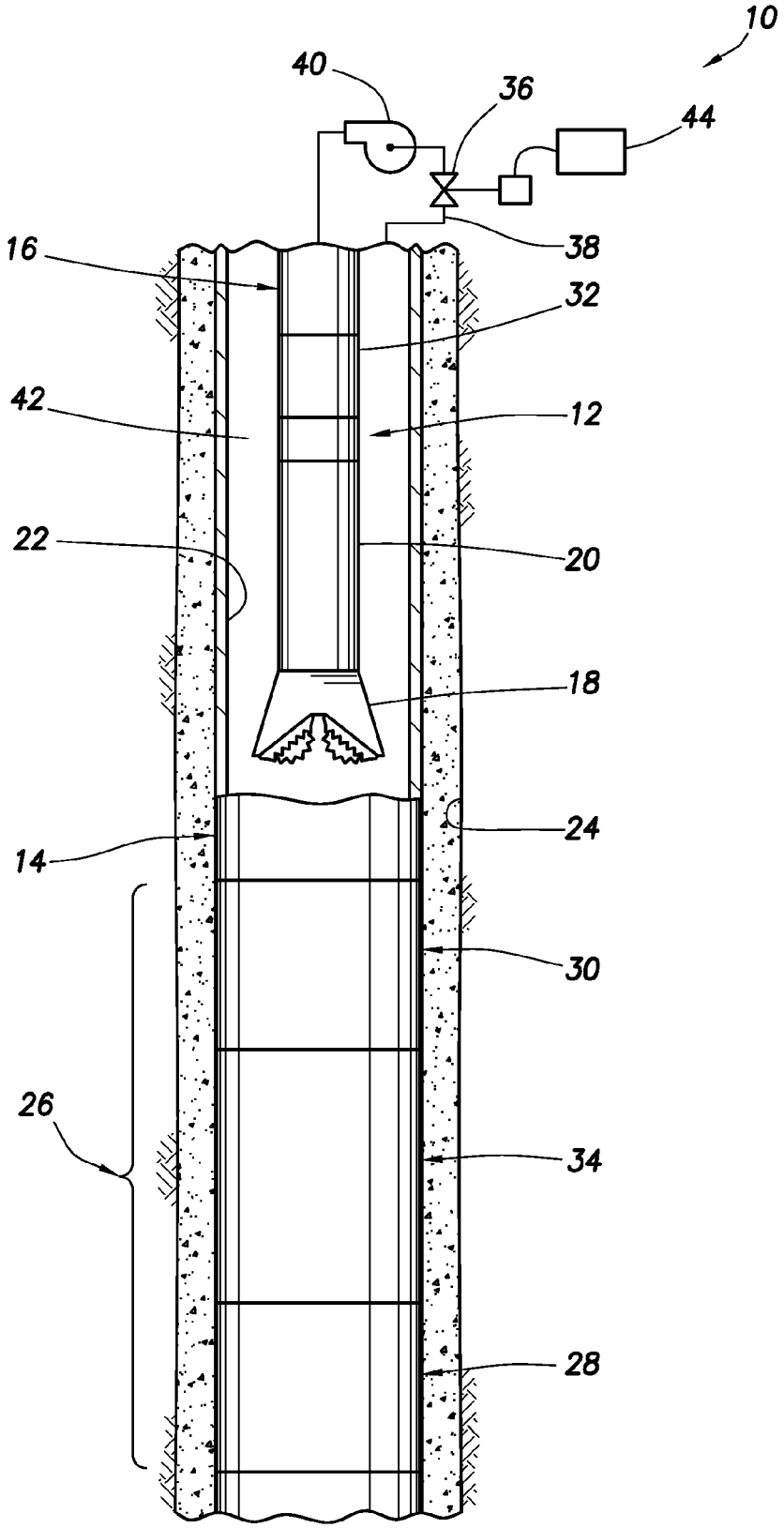
FIG. 1 is a schematic partially cross-sectional view of a well system and associated method which embody principles of the present disclosure.

Representatively illustrated in FIG. 1 is an example of a well system 10 and associated method which embody principles of the present disclosure. In the system 10 as depicted in FIG. 1, an assembly 12 is conveyed through a tubular string 14 in a well.

The tubular string 14 forms a protective lining for a wellbore 24 of the well. The tubular string 14 may be of the type known to those skilled in the art as casing, liner, tubing, etc. The tubular string 14 may be segmented, continuous, formed in situ, etc. The tubular string 14 may be made of any material.

The assembly 12 is illustrated as including a tubular drill string 16 having a drill bit 18 connected below a mud motor and/or turbine generator 20. The mud motor/turbine generator 20 is not necessary for operation of the well system 10 in keeping with the principles of this disclosure, but is depicted in FIG. 1 to demonstrate the wide variety of possible configurations which may be used.

In the example of FIG. 1, a signal transmitter 32 is also interconnected in the tubular string 16. The signal transmitter 32 can be used to open an isolation valve 26 interconnected in the tubular string 14, as the assembly 12 is conveyed downwardly through the valve. The signal transmitter 32 can also be used to close the isolation valve 26 as the assembly 12 is retrieved upwardly through the valve.

The isolation valve 26 functions to selectively isolate upper and lower sections of the wellbore 24 from each other. In the example of FIG. 1, the isolation valve 26 selectively permits and prevents fluid communication through an internal flow passage 22 which extends longitudinally through the tubular string 14, including through the isolation valve.

As depicted in FIG. 1, the isolation valve 26 includes a detector section 30, a control system 34 and a valve/actuator section 28. The detector section 30 functions to detect a signal, for example, to open or close the isolation valve 26. The control system 34 operates the valve/actuator section 28 when an appropriate signal has been detected by the detector section 30.

Although the valve/actuator section 28, detector section 30 and control system 34 are depicted in FIG. 1 as being separate components interconnected in the tubular string 14, any or all of these components could be integrated with each other, additional or different components could be used, etc. The configuration of components illustrated in FIG. 1 is merely one example of a wide variety of possible different configurations.

The signal detected by the detector section 30 could be transmitted from any location, whether remote or local. For example, the signal could be transmitted from the transmitter 32 of the tubular string 16, the signal could be transmitted from any object (such as a ball, dart, tubular string, etc.) which is present in the flow passage 22, the signal could be transmitted from the detector section itself, etc.

In one example, a pressure pulse signal can be transmitted from a remote location (such as the earth's surface, a wellsite rig, a sea floor, etc.) by selectively restricting flow through a flow control device 36. The flow control device 36 is depicted schematically in FIG. 1 as a choke of the type used in a fluid return line 38 during drilling operations.

Fluid (such as drilling fluid or mud) is pumped by a rig pump 40 through the tubular string 16, the fluid exits the tubular string at the bit 18, and returns to the surface via an annulus 42 formed radially between the tubular strings 14, 16. By momentarily restricting the flow of the fluid through the device 36, pressure pulses can be applied to the isolation valve 26 via the passage 22. The timing of the pressure pulses can be controlled with a controller 44 connected to the flow control device 36.

Many other remote signal transmission means may be used, as well. For example, electromagnetic, acoustic and other forms of telemetry may be used to transmit signals to the detector section 30. Lines (such as electrical conductors, optical waveguides, hydraulic lines, etc.) can extend from the detector section 30 to remote locations for transmitting signals to the detector section. Such lines could be incorporated into a sidewall of the tubular string 14 (for example, so that the lines are installed as the tubular string is installed), or the lines could be positioned internal or external to the tubular string.

Of course, various forms of telemetry could be used for transmitting signals to the detector section 30, even if the signals are not transmitted from a remote location. For example, electromagnetic, magnetic, radio frequency identification (RFID), acoustic, vibration, pressure pulse and other types of signals may be transmitted from an object (which may include the transmitter 32) which is locally positioned (such as, positioned in the passage 22).

In one example described more fully below, an inductive coupling is used to transmit a signal to the detector section 30. An inductive coupling may also be used to recharge batteries in the isolation valve 26, or to provide electrical power for operation of the isolation valve without the need for batteries. Electrical power for operation of the inductive coupling could be provided by flow of fluid through the turbine generator 20 in one example.

In the system 10 as representatively illustrated in FIG. 1, the isolation valve 26 isolates a lower section of the wellbore 24 from an upper section of the wellbore while the tubular string 16 is being tripped into and out of the wellbore. In this manner, pressure in the lower section of the wellbore 24 can be more precisely managed, for example, to prevent damage to a reservoir intersected by the lower section of the wellbore, to prevent loss of fluids, etc.

The isolation valve 26 is not necessarily used only in drilling operations. For example, the isolation valve 26 may be used in completion operations to prevent loss of completion fluids during installation of a production tubing string, etc. It will be appreciated that there are a wide variety of possible uses for a selectively operable isolation valve.

Figure 2A:
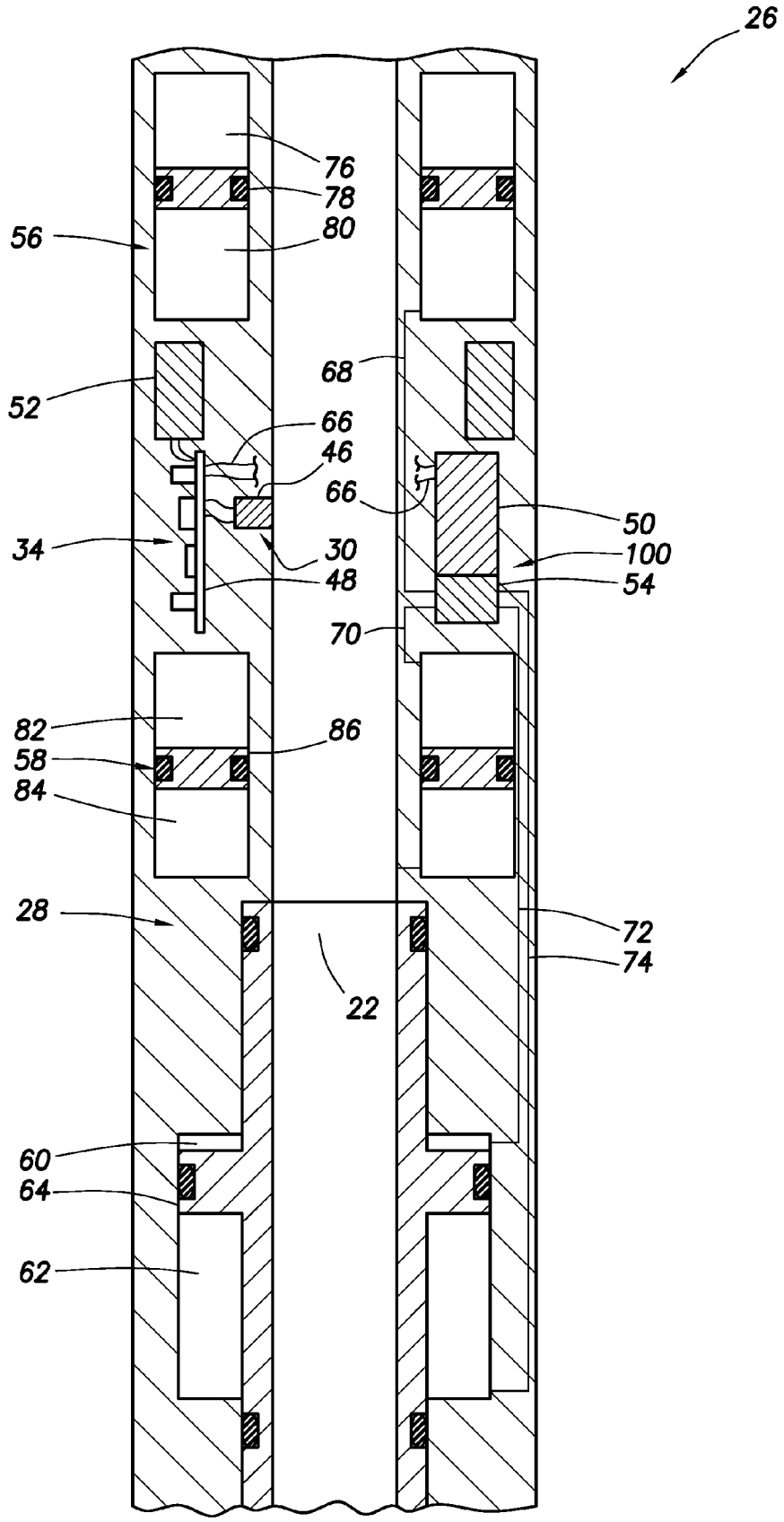
FIGS. 2A & B are schematic enlarged scale cross-sectional views of an isolation valve which may be used in the system and method of FIG. 1, the isolation valve embodying principles of this disclosure, and the isolation valve being depicted in an open configuration.

Referring additionally now to FIGS. 2A & B, a schematic cross-sectional view of one example of the isolation valve 26 is representatively illustrated, apart from the remainder of the well system 10. In this example, the detector section 30, control system 34 and valve/actuator section 28 are incorporated into a single assembly, but any number or combination of components, subassemblies, etc. may be used in the isolation valve 26 in keeping with the principles of this disclosure.

The detector section 30 is depicted as including a detector 46 which is connected to electronic circuitry 48 of the control system 34. Electrical power to operate the detector 46, electronic circuitry 48 and a motor 50 is supplied by one or more batteries 52.

In other examples, the batteries 52 may not be used if, for example, electrical power is supplied via an inductive coupling. However, even if an inductive coupling is provided, the batteries 52 may still be used, in which case, the batteries could be recharged downhole via the inductive coupling.

The motor 50 is used to operate a rotary valve 54 which selectively connects pressures sources 56, 58 to chambers 60, 62 exposed to opposing sides of a piston 64. Operation of the motor 50 is controlled by the control system 34, for example, via lines 66 extending between the control system and the motor.

The pressure source 56 supplies relatively high pressure to the rotary valve 54 via a line 68. The pressure source 58 supplies relatively low pressure to the rotary valve 54 via a line 70. The rotary valve 54 is in communication with the chambers 60, 62 via respective lines 72, 74.

The high pressure source 56 includes a chamber 76 containing a pressurized, compressible fluid (such as compressed nitrogen gas or silicone fluid, etc.). A floating piston 78 separates the chamber 76 from another chamber 80 containing hydraulic fluid.

The low pressure source 58 similarly includes a floating piston 86 separating chambers 82, 84, with the chamber 82 containing hydraulic fluid. However, the chamber 84 is in fluid communication via a line 88 with a relatively low pressure region in the well, such as the passage 22.

Figure 3B:
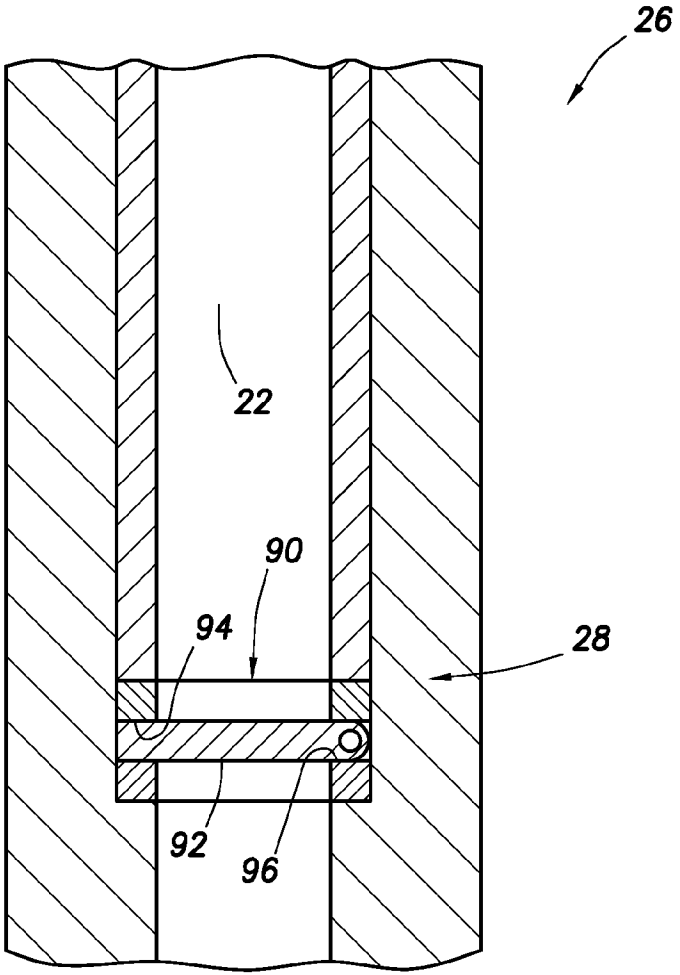
FIGS. 3A & B are schematic cross-sectional views of the isolation valve, with the isolation valve being depicted in a closed configuration.
Figure 2B:
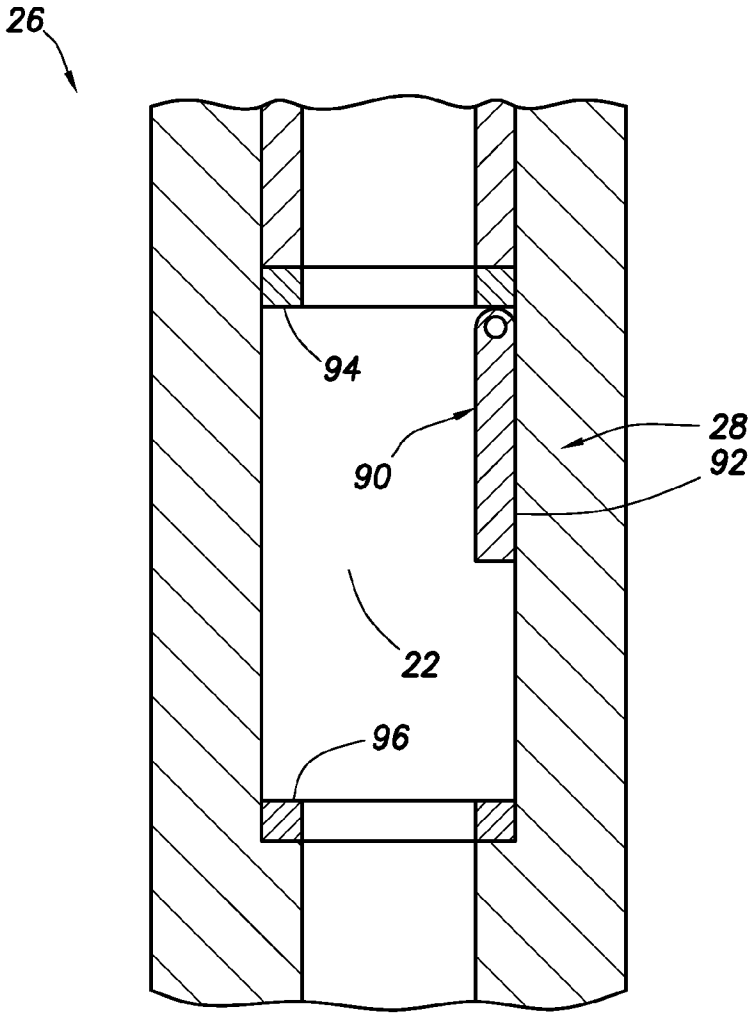
Figure 3A:
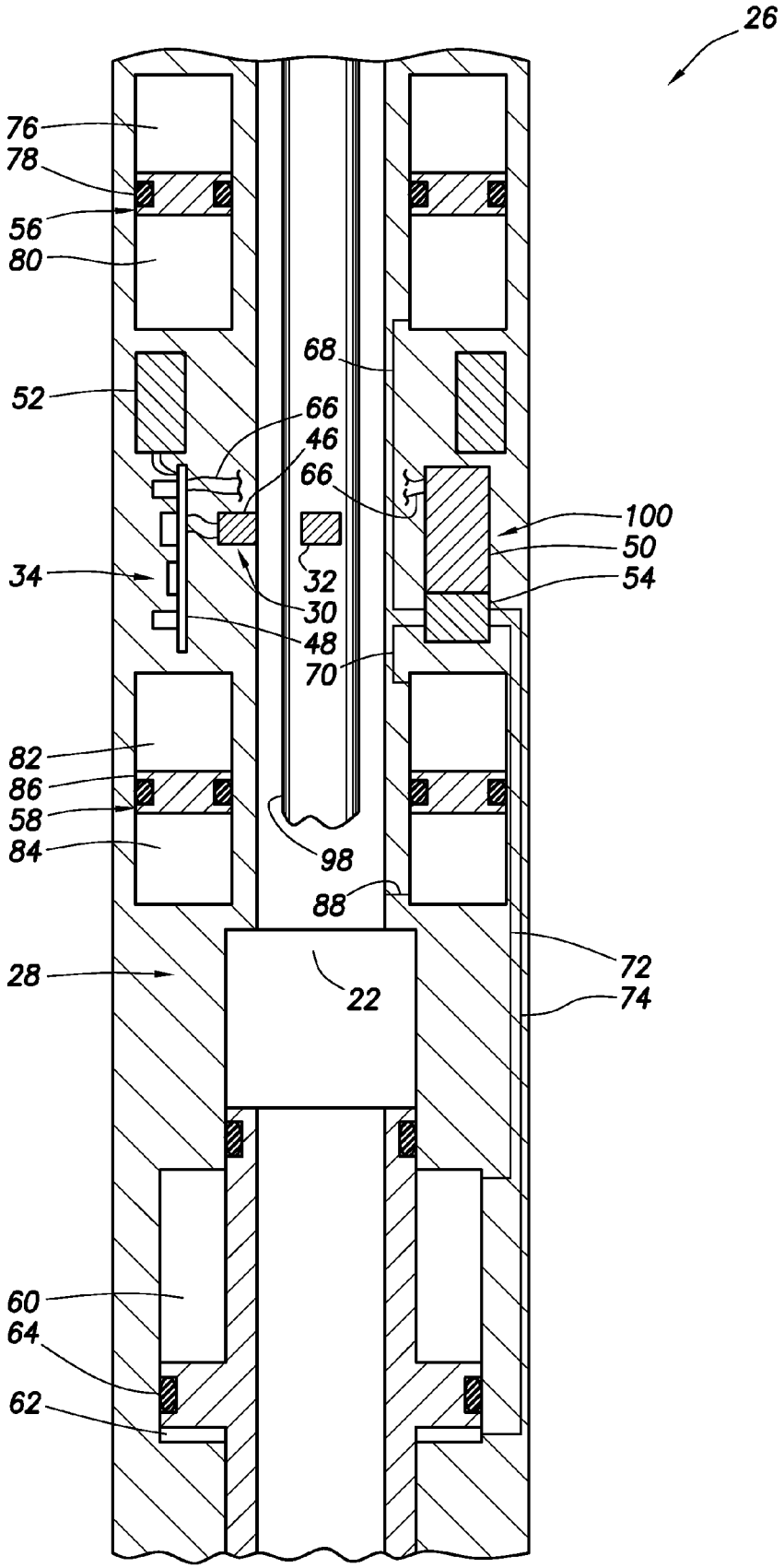

In the example of FIGS. 2A & B, a flapper valve 90 of the valve/actuator section 28 is opened when the piston 64 is in an upper position, and the flapper valve is closed (thereby preventing fluid communication through the passage 22) when the piston is in a lower position (see FIGS. 3A & B). Preferably, a flapper 92 of the valve 90 sealingly engages seats 94, 96 when the valve is closed, thereby preventing flow in both directions through the passage 22, when the valve is closed.

The pressure sources 56, 58, piston 64, chambers 60, 62, motor 50, rotary valve 54, lines 68, 70, 72, 74 and associated components can be considered to comprise an actuator 100 for operating the valve 90. To displace the piston 64 to its upper position, the rotary valve 54 is rotated by the motor 50, so that the high pressure source 56 is connected to the lower piston chamber 62, and the low pressure source 58 is connected to the upper piston chamber 60. Conversely, to displace the piston 64 to its lower position, the rotary valve 54 is rotated by the motor 50, so that the high pressure source 56 is connected to the upper piston chamber 60, and the low pressure source 58 is connected to the lower piston chamber 62.

As depicted in FIGS. 3A & B, an object 98 (such as a tubular string, bar, rod, etc.) is conveyed into the passage above the isolation valve 26. The object 98 includes the signal transmitter 32 which transmits a signal to the detector 46.

In response, the control system 34 causes the motor 50 to operate the rotary valve 54, so that relatively high pressure is applied to the lower piston chamber 62 and relatively low pressure is applied to the upper piston chamber 60. The piston 64, thus, displaces to its upper position (as depicted in FIGS. 2A & B), and the object 98 can then displace through the open valve 90, if desired.

Similarly, if the object 98 is retrieved through the open valve 90, then a signal transmitted from the transmitter 32 to the detector 46 can cause the control system 34 to operate the actuator 100 and close the valve 90 (i.e., by causing the motor 50 to operate the rotary valve 54, so that relatively high pressure is applied to the upper piston chamber 60 and relatively low pressure is applied to the lower piston chamber 62).

As depicted in FIG. 3B, the isolation valve 26 can selectively prevent fluid communication between sections of the wellbore 24, with the isolation valve 26 preventing fluid flow in each of first and second opposite directions through the flow passage 22 extending longitudinally through the isolation valve 26. Note that the flapper 92 is sealingly engaged with each of the seats 94, 96, thereby preventing fluid flow through the passage 22 in both upward and downward directions, as viewed in FIG. 3B.

Figure 4:
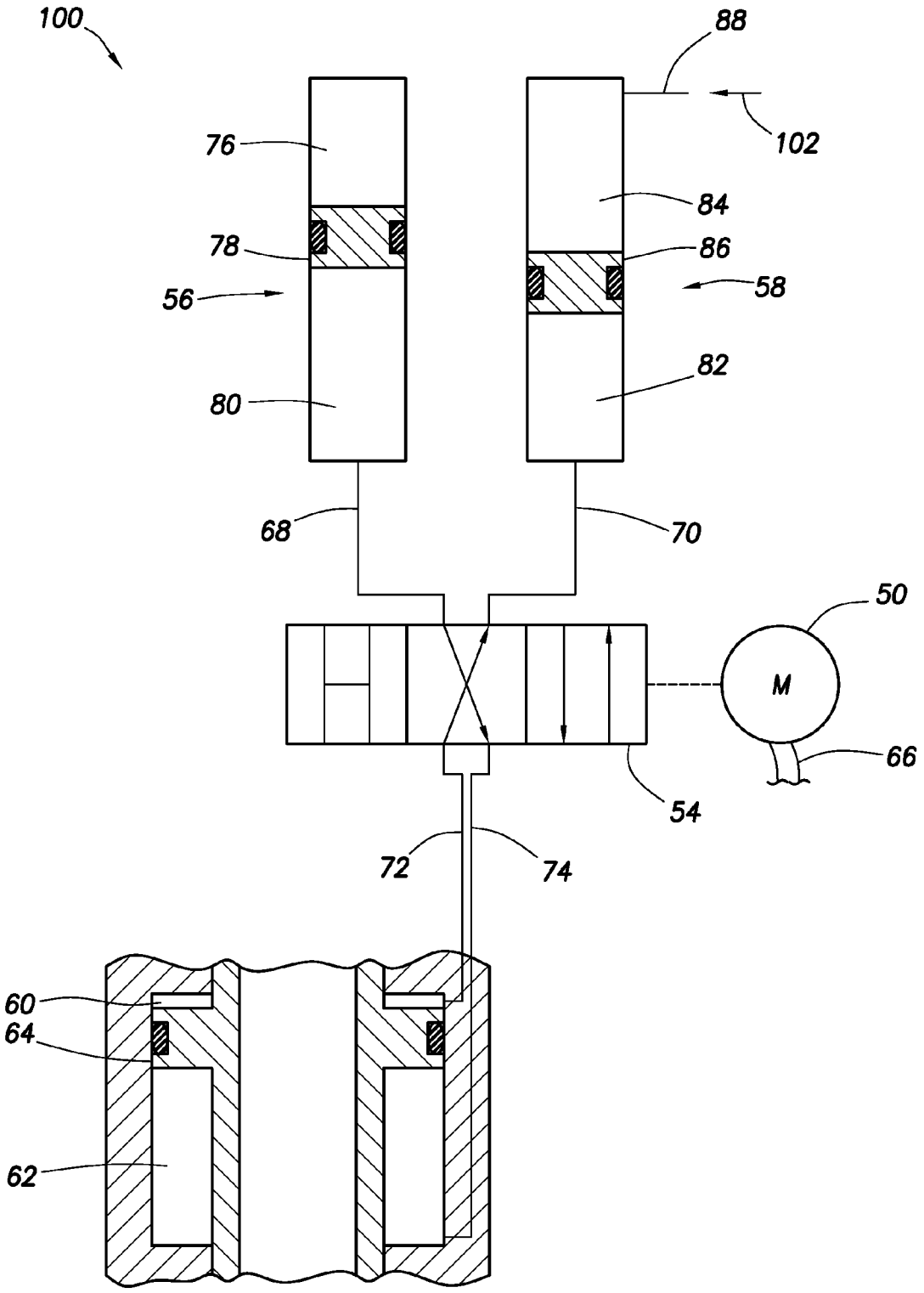
FIG. 4 is a schematic hydraulic circuit diagram for an actuator of the isolation valve.

A schematic hydraulic circuit diagram for the actuator 100 is representatively illustrated in FIG. 4. In this circuit diagram, it may be seen that the rotary valve 54 is capable of connecting the lines 68, 70 to respective lines 74, 72 (as depicted in FIG. 4), is capable of connecting the lines 68, 70 to respective lines 72, 74 (i.e., reversed from that depicted in FIG. 4), and is capable of connecting all of the lines 68, 70, 72, 74 to each other.

The latter position of the rotary valve 54 is useful for recharging the high pressure source 56 downhole. With all of the lines 68, 70, 72, 74 connected to each other, pressure 102 applied via the line 88 to the chamber 84 will be transmitted to the chamber 76, which may become depressurized after repeated operation of the actuator 100.

It will be appreciated that, as the actuator 100 is operated to upwardly or downwardly displace the piston 64, the volume of the chamber 76 expands. As the chamber 76 volume expands, the pressure of the fluid therein decreases.

Eventually, the fluid pressure in the chamber 76 may be insufficient to operate the actuator 100 as desired. In that event, the rotary valve 54 may be operated to its position in which the lines 68, 70, 72, 74 are connected to each other, and elevated pressure 102 may be applied to the passage 22 (or other relatively low pressure region) to thereby recharge the chamber 76 by compressing it and thereby increasing the pressure of the fluid therein.

Figure 5A:
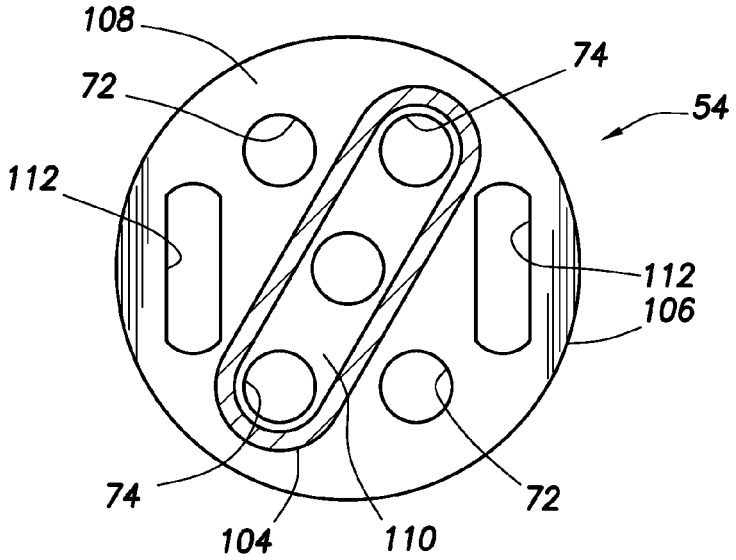
FIGS. 5A-C are enlarged scale schematic partially cross-sectional views of various configurations of a rotary valve of the actuator.
Figure 5B:
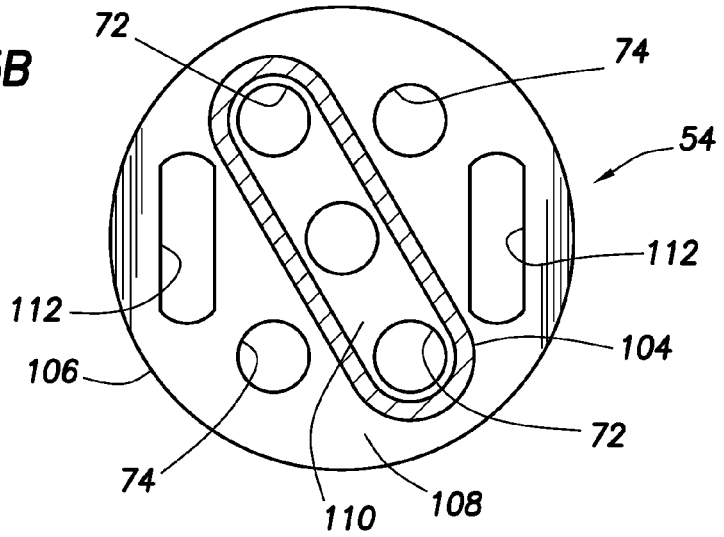
Figure 5C:
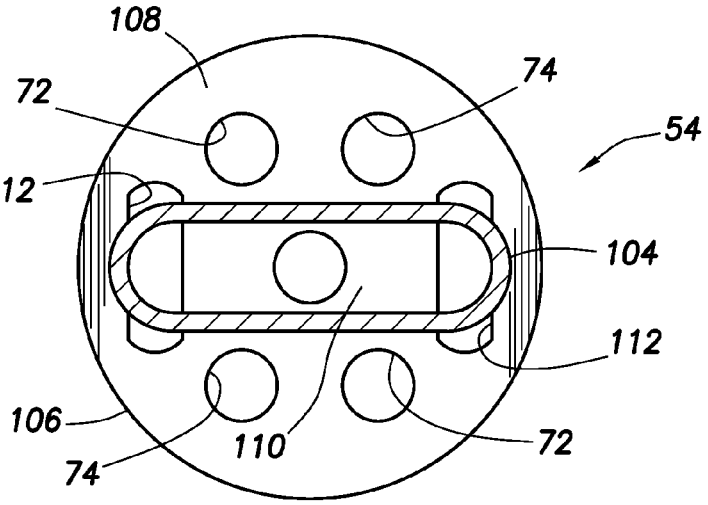

Referring additionally now to FIGS. 5A-C, enlarged scale schematic views of various positions of the rotary valve 54 are representatively illustrated apart from the remainder of the actuator 100. In these views, it may be seen that the rotary valve 54 includes a rotor 104 which sealingly engages a ported plate 106.

The sealing between the rotor 104 and the plate 106 is due to their mating surfaces being very flat, hardened and precisely ground, so that planar face sealing is accomplished. The rotor 104 is surrounded by a relatively high pressure region 108 (connected to the high pressure source 56 via the line 68), and a relatively low pressure region 110 (connected to the low pressure source 58 via the line 70), so the pressure differential across the rotor causes it to be biased into sealing contact with the plate 106.

As depicted in FIG. 5A, the rotor 104 is oriented relative to the plate 106 so that the lines 74 are in communication with the low pressure region 110 and the lines 72 are in communication with the high pressure region 108 (multiple lines 72, 74 are preferably used for balance and to provide more flow area, so that the valve 90 operates more quickly). Thus, the valve 90 will be closed, as shown in FIGS. 3A & B.

As depicted in FIG. 5B, the rotor 104 is oriented relative to the plate 106 so that the lines 74 are in communication with the high pressure region 108 and the lines 72 are in communication with the low pressure region 110. Thus, the valve 90 will be opened, as shown in FIGS. 2A & B.

As depicted in FIG. 5C, the rotor 104 is oriented so that ends of the rotor overlie shallow recesses 112 formed on the plate 106. In this position, the high and low pressure regions 108, 110 are in communication with each other, and in communication with each of the lines 72, 74. This is the position of the rotor 104 for recharging the chamber 76 as described above.

Note that the rotor 104 can reach the recharge position shown in FIG. 5C from the position shown in either of FIG. 5A or 5B. When the rotor 104 is in the position shown in FIG. 5C, there is no net change in pressure across the piston 64, and the valve 90 should remain in place without movement. For this reason, the chamber 76 can be recharged whether the valve 90 is in its open or closed position.

The motor 50 can rotate the rotor 104 to each of the positions depicted in FIGS. 5A-C as needed to operate the actuator 100, under control of the control system 34. However, note that it is not necessary for a motor 50 or rotary valve 54 to be used in the actuator 100 since, for example, a shuttle valve, a series of poppet or solenoid valves, or any other type of valving arrangement may be used, as desired.

Figure 6:
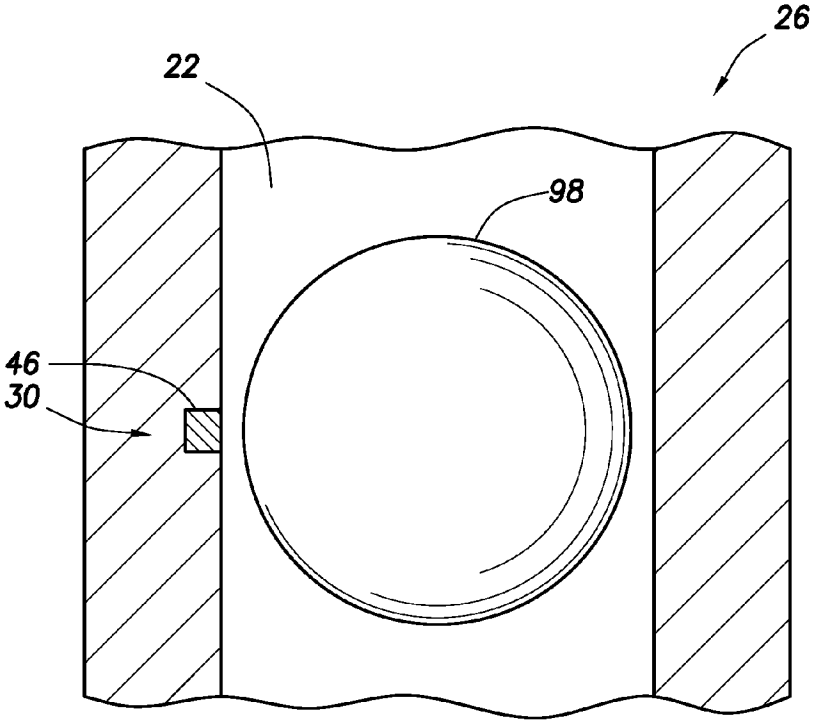

Referring additionally now to FIG. 6, an example of one method of detecting the presence of an object 98 in the passage 22 is representatively illustrated. Note that, in this example, the object 98 is in the shape of a ball, which may be dropped, circulated or otherwise conveyed through the passage 22 to the isolation valve 26, in order to open or close the valve. Any type of object (such as a ball, dart, tubular string, rod, bar, cable, wire, etc.) having any shape may be used in keeping with the principles of this disclosure.

As depicted in FIG. 6, the detector 46 of the detector section 30 detects the presence of the object 98 in the flow passage 22. In one example, the detector 46 could be an accelerometer or vibration sensor which detects vibrations caused by movement of the object 98 in the passage 22. In another example, the detector could be an acoustic sensor which detects acoustic noise generated by the movement of the object 98 in the passage 22. In another example, the detector 46 could be a Hall effect sensor which detects a magnetic field of the object 98 (i.e., if the object is magnetized). In another example, the detector 46 could be a magnetic sensor which detects a change in a magnetic field strength due to the presence of the object 98 in the passage 22 (in which case the magnetic field could be generated by the isolation valve 26 itself). In another example, the detector 46 could be a pressure sensor which detects pressure signals (such as the pressure pulses generated by the flow control device 36, as described above).

Figure 7:
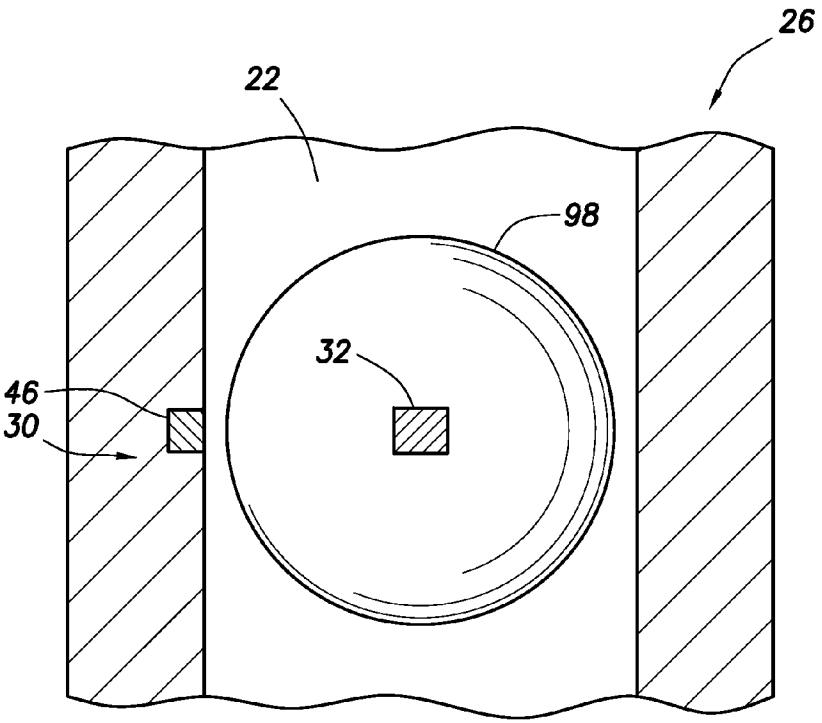
FIGS. 6-11 are schematic partially cross-sectional views of additional configurations of a detector section of the isolation valve.

Representatively illustrated in FIG. 7 is yet another example, in which the signal transmitter 32 is incorporated into the object 98. A signal transmitted from the transmitter 32 to the detector 46 could be any type of signal, including acoustic, electromagnetic, magnetic, radio frequency identification (RFID), vibration, pressure pulse, etc.

Figure 8:
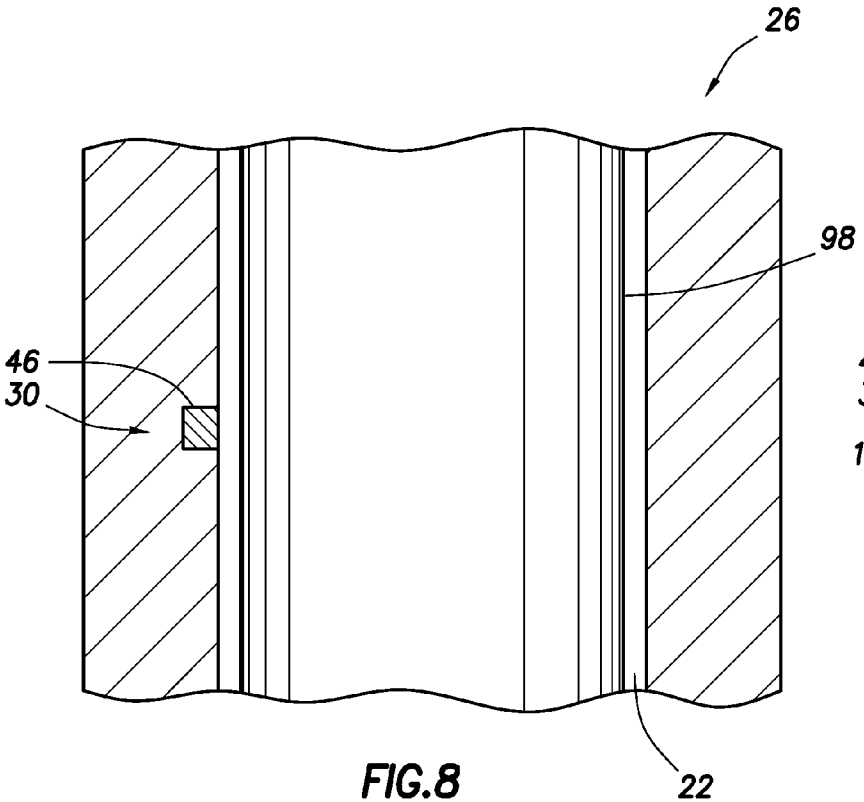

Representatively illustrated in FIG. 8 is a further example, in which the object 98 is in the form of a tubular string. The detector 46 comprises an acoustic transceiver (a combination of an acoustic signal transmitter and an acoustic signal receiver). The detector 46 detects the presence of the object 98 in the passage by detecting a reflection of an acoustic signal transmitted from the acoustic signal transmitter to the acoustic signal receiver, with the signal being reflected off of the object in the passage 22.

Figure 9:
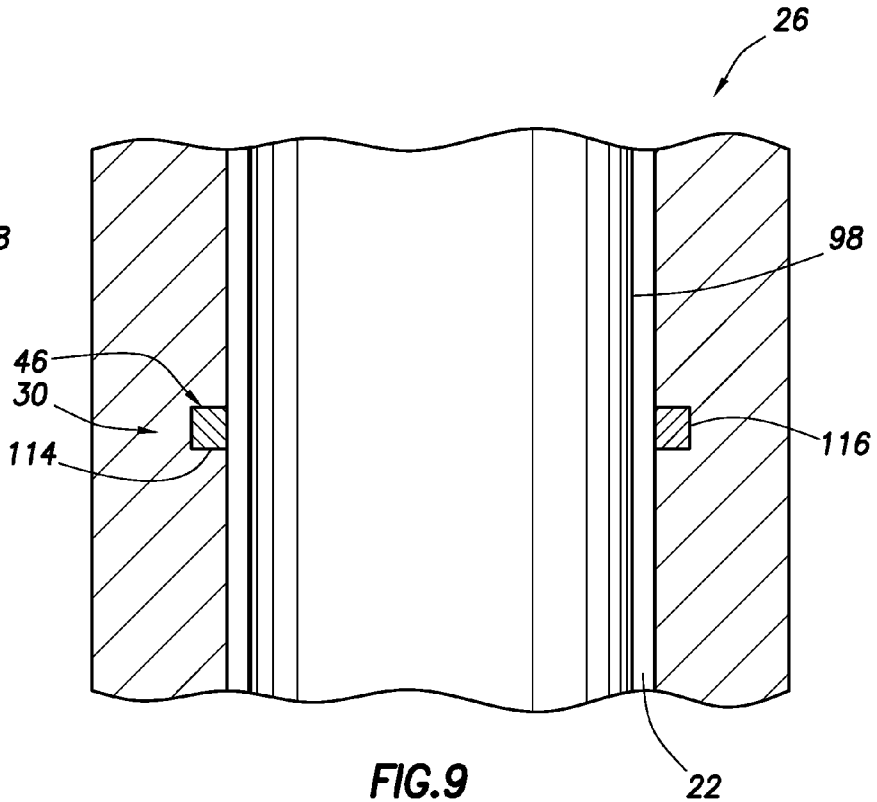

Representatively illustrated in FIG. 9 is another example, in which the object 98 is again in the form of a tubular string, but the detector 46 comprises a separate acoustic signal transmitter 114 and an acoustic signal receiver 116, preferably spaced apart from each other (e.g., on opposite sides of the passage 22). When the object 98 is appropriately positioned in the passage 22, an acoustic signal transmitted by the transmitter 114 is interrupted by the object, so that it is not received by the receiver 116 (or the received signal is delayed and/or distorted, etc.), and the detector 46 is thereby capable of detecting the presence of the object.

Figure 10:
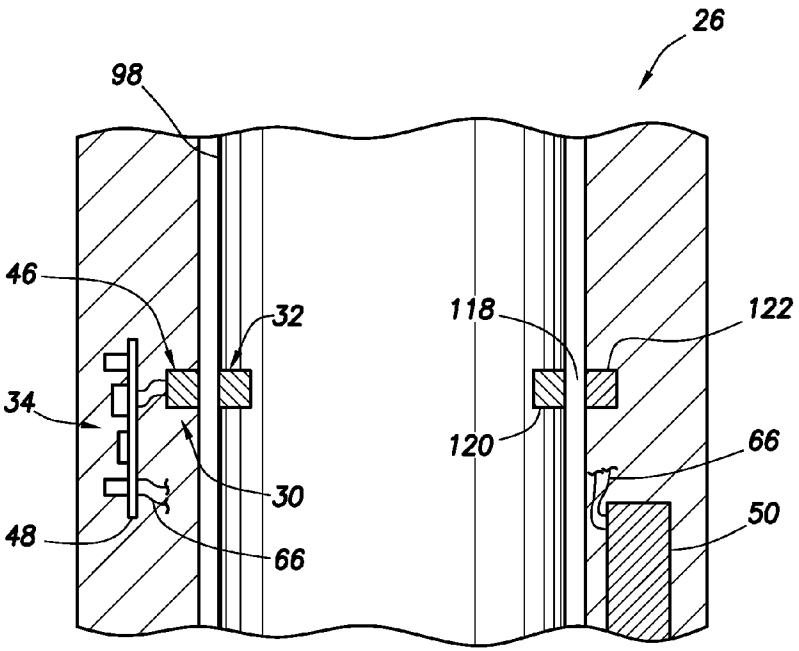

Representatively illustrated in FIG. 10 is another example, in which an inductive coupling 118 is formed between the object 98 and the detector section 30. More specifically, the signal transmitter 32 includes a coil 120 which inductively couples with a coil 122 of the detector 46.

Data and/or command signals may be transmitted from the signal transmitter 32 to the detector 46 via the inductive coupling 118. Alternatively, or in addition, the inductive coupling 118 may be used to transmit electrical power to charge the batteries 52. As depicted in FIG. 10, the isolation valve 26 may even be operated without the use of batteries 52, if sufficient electrical power can be transmitted via the inductive coupling 118.

Figure 11:
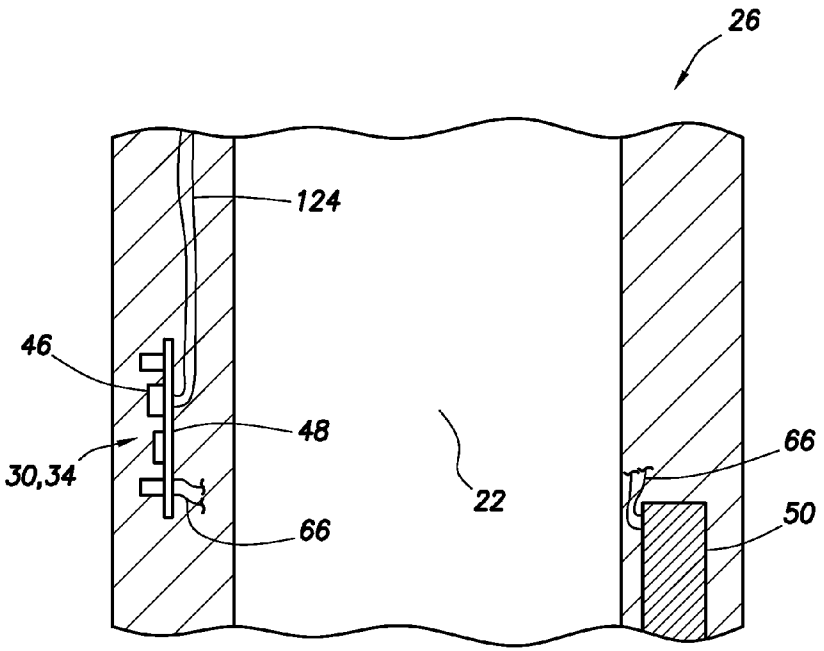

Representatively illustrated in FIG. 11 is another example in which signals to operate the isolation valve 26 may be transmitted via one or more lines 124 extending to a remote location. The lines 124 could be electrical, optical, hydraulic or any other types of lines.

In the example of FIG. 11, the lines 124 are connected directly to a combined detector section 30 and control system 34. For example, the detector 46 could be a component of the electronic circuitry 48.

The lines 124 may extend to the remote location in a variety of different manners. In one example, the lines 124 could be incorporated into a sidewall of the tubular string 14, or they could be positioned external or internal to the tubular string.

Figure 12:
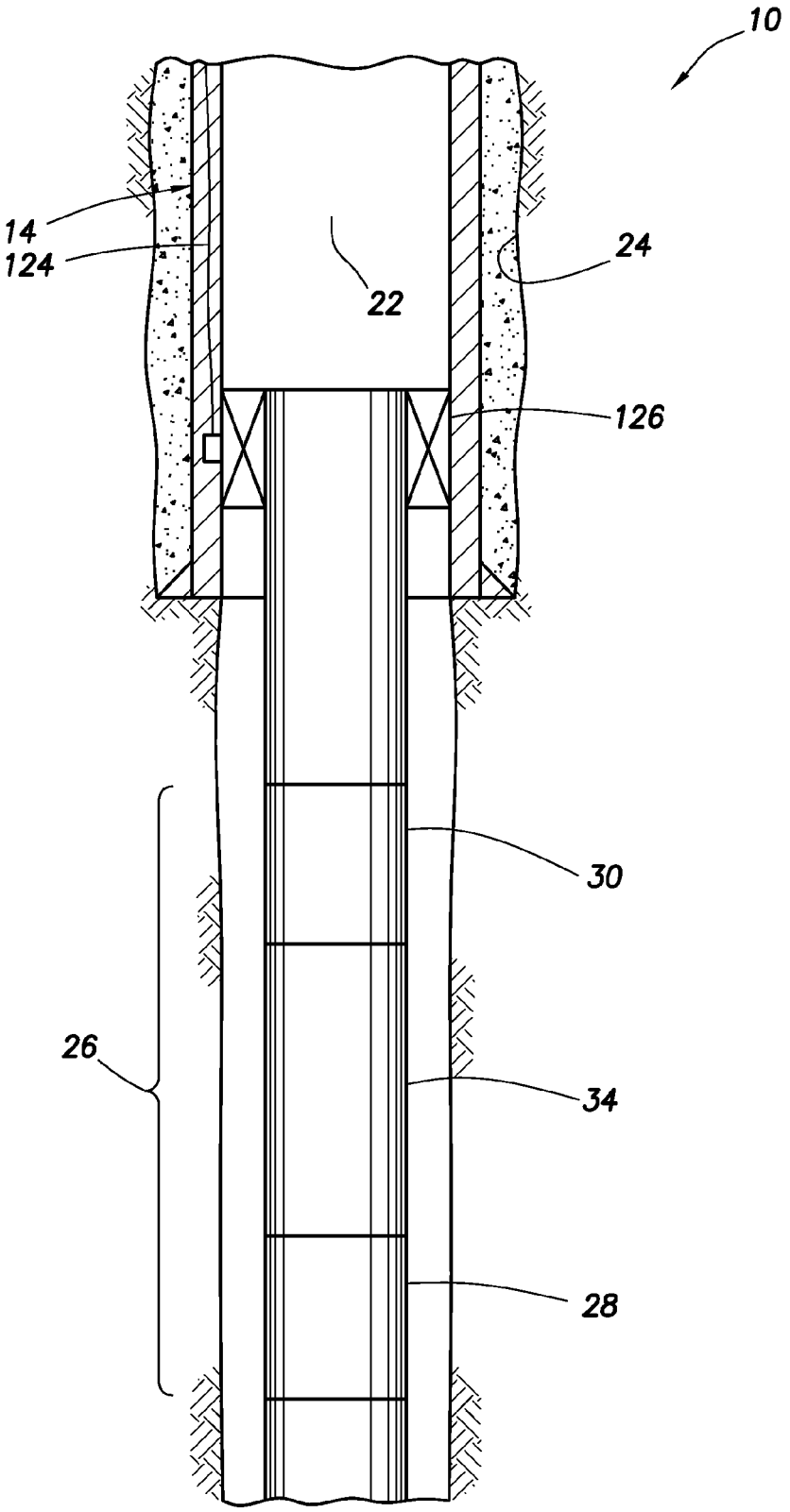
FIG. 12 is a schematic partially cross-sectional view of another configuration of the system and method of FIG. 1.

Referring additionally now to FIG. 12, another configuration of the well system 10 is representatively illustrated, in which the isolation valve 26 is secured to the tubular string 14 by means of a releasable anchor 126 (for example, in the form of a specialized liner hanger). If the lines 124 are used for transmitting signals to the isolation valve 26, then setting the anchor 126 may result in connecting the lines 124 to the detector section 30 and/or control system 34.

When desired, the isolation valve 26 may be retrieved from the wellbore 24 by releasing the anchor 126. In this manner, the valuable isolation valve 26 may be used again in other wells.

Note that, in the configuration of FIG. 12, the isolation valve 26 provides for selective fluid communication and isolation between cased and uncased sections of the wellbore 24. In other examples (such as the example of FIG. 1), the isolation valve 26 may provide for selective fluid communication and isolation between two cased sections of a wellbore, or between two uncased sections of a wellbore.

Although the principles of this disclosure have been described above in relation to several specific separate examples, it will be readily appreciated that any of the features of any of the examples may be conveniently incorporated into, or otherwise combined with, any of the other examples. Thus, the examples are not in any manner intended to demonstrate mutually exclusive features.

It may now be fully appreciated that the above disclosure provides many advancements to the art. The examples of systems and methods described above can provide for convenient and reliable isolation between sections of a wellbore, as needed.

Specifically, the above disclosure provides to the art a unique method of operating an isolation valve 26 in a subterranean well. The method can include transmitting a signal to a detector section 30 of the isolation valve 26, and a control system 34 of the isolation valve 26 operating an actuator 100 of the isolation valve 26 in response to detection of the signal by the detector section 30.

The signal may be transmitted from a remote location. For example, the signal may be transmitted via at least one line 124 extending to the remote location. The line 124 could be incorporated into a sidewall of a tubular string 14 in the well, disposed external to a tubular string 14 which forms a protective lining for a wellbore 24, etc. As another example, the signal may comprise a pressure pulse generated by restricting flow through a flow control device 36.

The signal could be transmitted from an object 98 positioned within an internal flow passage 22 of the isolation valve 26. Such an object 98 could be, for example, a ball, a dart, a cable, a wire, a tubular string (such as, a completion string, a drill string, etc.).

The signal may comprise an acoustic signal, an electromagnetic signal, a radio frequency identification (RFID) signal, a magnetic field, a pressure pulse and/or a vibration.

The actuator 100 may comprise a pressure source 56 including a pressurized fluid chamber 76 which expands as the isolation valve 26 is opened or closed. The method may include recharging the pressure source 56 downhole by compressing the chamber 76.

The method may include securing the isolation valve 26 to a tubular string 14 in the well by setting a releasable anchor 126 in the tubular string 14. Setting the releasable anchor 126 could include connecting the isolation valve 26 to at least one line 124 extending along the tubular string 14. The method may include retrieving the isolation valve 26 from the well by releasing the releasable anchor 126.

The detector section 30 may detect a presence of an object 98 in an inner flow passage 22 of the isolation valve 26 by detecting an interruption in the signal transmitted from an acoustic signal transmitter 114 to an acoustic signal receiver 116, with the interruption being caused by the presence of the object 98 in the inner flow passage 22. In addition, or as an alternative, the detector section 30 may detect the presence of the object 98 in the inner flow passage 22 of the isolation valve 26 by detecting a reflection of the signal transmitted from an acoustic signal transmitter to an acoustic signal receiver (e.g., with both incorporated in the detector 46), with the signal being reflected off of the object 98 in the inner flow passage 22.

The method can include recharging a battery 52 of the isolation valve 26 downhole. The recharging may be performed via an inductive coupling 118.

Electrical power for operating the actuator 100 may be supplied via an inductive coupling 118, without use of any battery 52 in the isolation valve 26.

The method may include flowing fluid through a tubular string 16 disposed in an internal flow passage 22 of the isolation valve 26, thereby generating electrical power from a generator 20 interconnected in the tubular string 16. The electrical power can be used for operating the actuator 100. The electrical power may be transmitted from the generator 20 to the isolation valve 26 via an inductive coupling 118.

An actuator 100 of the isolation valve 26 may include a rotary valve 54 which selectively permits and prevents fluid communication between multiple pressure sources 56, 58 and multiple chambers 60, 62. The method can include operating the rotary valve 54 so that fluid communication is permitted between the pressure sources 56, 58 and the chambers 60, 62, displacing a piston 64 of the actuator 100 in response to a pressure differential between the chambers 60, 62, and then operating the rotary valve 54 so that the pressure sources 56, 58 are connected to each other, without causing displacement of the piston 64.

Also provided to the art by the above disclosure is the isolation valve 26 itself for use in a subterranean well. The isolation valve 26 can include a detector section 30 which detects a presence of an object 98 in the isolation valve 26, and a control system 34 which operates an actuator 100 of the isolation valve 26 in response to an object 98 presence indication received from the detector section 30.

The detector section 30 may include a radio frequency identification (RFID) sensor, an acoustic sensor, an electromagnetic signal receiver, a magnetic field sensor, a Hall effect sensor, an accelerometer a pressure sensor and/or any other type of detector or sensor.

The detector section 30 can include an acoustic signal transmitter 114, and an acoustic signal receiver 116, with the transmitter 114 being spaced apart from the receiver 116, whereby the presence of the object 98 between the transmitter 114 and receiver 116 may be detected.

The detector section 30 may detect an acoustic signal transmitted from a remote location via a tubular string 14, 16, or via fluid in the well.

The above disclosure also describes a well system 10 which may include an isolation valve 26 which selectively permits and prevents fluid communication between sections of a wellbore 24. The isolation valve 26 includes a detector section 30 which detects a signal, and a control system 34 which operates an actuator 100 of the isolation valve 26 in response to detection of the signal by the detector section 30.

The isolation valve 26 can selectively prevent fluid communication between the sections of the wellbore 24, with the isolation valve 26 preventing fluid flow in each of first and second opposite directions through a flow passage 22 extending longitudinally through the isolation valve 26.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the above description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of operating an isolation valve in a subterranean well, the method comprising:

transmitting a signal to a detector section of the isolation valve;

operating an actuator of the isolation valve in response to detection of the signal by the detector section, the actuator including an actuator valve which selectively permits and prevents fluid communication between high and low pressure sources and first and second piston chambers of a piston of the actuator;

operating the actuator valve so that fluid communication is permitted between the high pressure source and the first piston chamber and between the low pressure source and the second piston chamber, thereby displacing the piston in a first direction;

operating the actuator valve so that fluid communication is permitted between the low pressure source and the first piston chamber and between the high pressure source and the second piston chamber, thereby displacing the piston in a second direction opposite the first direction; and operating the actuator valve so that fluid communication is permitted between the first and second piston chambers and the high and low pressure sources, thereby permitting the high pressure source to be recharged downhole.

2. The method of claim 1, wherein the signal is transmitted from a remote location.

3. The method of claim 2, wherein the signal is transmitted via at least one line extending to the remote location.

4. The method of claim 3, wherein the line is incorporated into a sidewall of a tubular string in the well.

5. The method of claim 3, wherein the line is disposed external to a tubular string which forms a protective lining for a wellbore.

6. The method of claim 2, wherein the signal comprises a pressure pulse generated by restricting flow through a flow control device.

7. The method of claim 1, wherein the signal is transmitted from an object positioned within an internal flow passage of the isolation valve.

8. The method of claim 1, wherein the signal comprises an acoustic signal.

9. The method of claim 1, wherein the signal comprises an electromagnetic signal.

10. The method of claim 1, wherein the signal comprises a radio frequency identification signal.

11. The method of claim 1, wherein the signal comprises a magnetic field.

12. The method of claim 1, wherein the signal comprises a vibration.

13. The method of claim 1, wherein the high pressure source includes a pressurized fluid chamber which expands as the isolation valve is actuated, and wherein the high pressure source is recharged downhole by compressing the fluid chamber.

14. The method of claim 1, further comprising securing the isolation valve to a tubular string in the well by setting a releasable anchor in the tubular string.

15. The method of claim 14, wherein setting the releasable anchor further comprises connecting the isolation valve to at least one line extending along the tubular string.

16. The method of claim 14, further comprising retrieving the isolation valve from the well by releasing the releasable anchor.

17. The method of claim 1, further comprising the detector section detecting a presence of an object in an inner flow passage of the isolation valve by detecting a reflection of the signal transmitted from an acoustic signal transmitter to an acoustic signal receiver, the signal being reflected off of the object in the inner flow passage.

18. The method of claim 1, further comprising recharging a battery of the isolation valve downhole.

19. The method of claim 18, wherein the recharging is performed via an inductive coupling.

20. The method of claim 1, wherein electrical power for operating the actuator is supplied via an inductive coupling, without use of any battery in the isolation valve.

21. The method of claim 1, further comprising flowing fluid through a tubular string disposed in an internal flow passage of the isolation valve, thereby generating electrical power from a generator interconnected in the tubular string, and the electrical power being used for operating the actuator.

22. The method of claim 21, wherein the electrical power is transmitted from the generator to the isolation valve via an inductive coupling.

23. The method of claim 1, wherein a position of the isolation valve does not change during recharging of the high pressure source, and wherein the high pressure source can be recharged when the isolation valve is in an open position and when the isolation valve is in a closed position.

24. A method of operating an isolation valve in a subterranean well, the method comprising:

transmitting a signal to a detector section of the isolation valve, the detector section detecting a presence of an object in an inner flow passage of the isolation valve by detecting an interruption in the signal transmitted from an acoustic signal transmitter to an acoustic signal receiver, the interruption being caused by the presence of the object in the inner flow passage; and a control system of the isolation valve operating an actuator of the isolation valve in response to detection of the signal by the detector section.

25. An isolation valve for use in a subterranean well, the isolation valve comprising:

a detector section which detects a presence of an object in the isolation valve; and a control system which operates an actuator of the isolation valve in response to an object presence indication received from the detector section, the actuator including a rotary valve which selectively permits and prevents fluid communication between high and low pressure sources and first and second piston chambers of a piston of the actuator, wherein a first position of the rotary valve permits fluid communication between the high pressure source and the first piston chamber and between the low pressure source and the second piston chamber, thereby displacing the piston in a first direction, wherein a second position of the rotary valve permits fluid communication between the low pressure source and the first piston chamber and between the high pressure source and the second piston chamber, thereby displacing the piston in a second direction opposite the first direction, and wherein a third position of the rotary valve permits fluid communication between the first and second piston chambers and the high and low pressure sources, thereby permitting the high pressure source to be recharged downhole.

26. The isolation valve of claim 25, wherein the detector section includes a radio frequency identification sensor.

27. The isolation valve of claim 25, wherein the detector section includes an acoustic sensor.

28. The isolation valve of claim 25, wherein the detector section includes an electromagnetic signal receiver.

29. The isolation valve of claim 25, wherein the detector section includes a magnetic field sensor.

30. The isolation valve of claim 25, wherein the detector section includes a Hall effect sensor.

31. The isolation valve of claim 25, wherein the detector section detects an acoustic signal transmitted from a remote location via a tubular string.

32. The isolation valve of claim 25, wherein the detector section detects an acoustic signal transmitted from a remote location via fluid in the well.

33. The isolation valve of claim 25, wherein the detector section includes an accelerometer.

34. An isolation valve for use in a subterranean well, the isolation valve comprising:

a detector section which detects a presence of an object in the isolation valve; and a control system which operates an actuator of the isolation valve in response to an object presence indication received from the detector section, wherein the detector section includes an acoustic signal transmitter, and an acoustic signal receiver, the transmitter being spaced apart from the receiver, whereby the presence of the object between the transmitter and receiver may be detected.

35. A well system, comprising:

an isolation valve which selectively permits and prevents fluid communication between sections of a wellbore;

the isolation valve including a detector section which detects a signal; and the isolation valve further including a control system which operates an actuator of the isolation valve in response to detection of the signal by the detector section, wherein the actuator includes a rotary valve which selectively permits and prevents fluid communication between high and low pressure sources and first and second piston chambers of a piston of the actuator, wherein a first position of the rotary valve permits fluid communication between the high pressure source and the first piston chamber and between the low pressure source and the second piston chamber, thereby displacing the piston in a first direction, wherein a second position of the rotary valve permits fluid communication between the low pressure source and the first piston chamber and between the high pressure source and the second piston chamber, thereby displacing the piston in a second direction opposite the first direction, and wherein a third position of the rotary valve permits fluid communication between the first and second piston chambers and the high and low pressure sources, thereby permitting the high pressure source to be recharged downhole.

36. The well system of claim 35, wherein the signal is transmitted from a remote location.

37. The well system of claim 36, wherein the signal is transmitted via at least one line extending to the remote location.

38. The well system of claim 37, wherein the line is incorporated into a sidewall of a tubular string in the well.

39. The well system of claim 37, wherein the line is disposed external to a tubular string which forms a protective lining for the wellbore.

40. The well system of claim 36, wherein the signal comprises a pressure pulse generated by restricting flow through a flow control device.

41. The well system of claim 35, wherein the signal is transmitted from an object positioned within an internal flow passage of the isolation valve.

42. The well system of claim 35, wherein the signal comprises an acoustic signal.

43. The well system of claim 35, wherein the signal comprises an electromagnetic signal.

44. The well system of claim 35, wherein the signal comprises a radio frequency identification signal.

45. The well system of claim 35, wherein the signal comprises a magnetic field.

46. The well system of claim 35, wherein the signal comprises a vibration.

47. The well system of claim 35, wherein the high pressure source includes a pressurized fluid chamber which expands as the isolation valve is actuated, and wherein the high pressure source is recharged downhole via compression of the fluid chamber.

48. The well system of claim 35, wherein the isolation valve is secured to a tubular string in the well by a releasable anchor set in the tubular string.

49. The well system of claim 48, wherein the releasable anchor comprises a connection between the isolation valve and at least one line extending along the tubular string.

50. The well system of claim 48, wherein the isolation valve is retrievable from the well upon release of the releasable anchor.

51. The well system of claim 35, wherein the detector section detects a presence of an object in an inner flow passage of the isolation valve via detection of a reflection of the signal transmitted from an acoustic signal transmitter to an acoustic signal receiver, the signal being reflected off of the object in the inner flow passage.

52. The well system of claim 35, wherein a battery of the isolation valve is recharged downhole.

53. The well system of claim 52, wherein the battery is recharged via an inductive coupling.

54. The well system of claim 35, wherein electrical power for operation of the actuator is supplied via an inductive coupling, without use of any battery in the isolation valve.

55. The well system of claim 35, wherein fluid flows through a tubular string disposed in an internal flow passage of the isolation valve, whereby electrical power is generated by a generator interconnected in the tubular string, and the electrical power is used for operation of the actuator.

56. The well system of claim 55, wherein the electrical power is transmitted from the generator to the isolation valve via an inductive coupling.

57. The well system of claim 35, wherein the isolation valve selectively prevents fluid communication between the sections of the wellbore, with the isolation valve preventing fluid flow in each of first and second opposite directions through a flow passage extending longitudinally through the isolation valve.

58. A well system, comprising:

an isolation valve which selectively permits and prevents fluid communication between sections of a wellbore;

the isolation valve including a detector section which detects a signal; and the isolation valve further including a control system which operates an actuator of the isolation valve in response to detection of the signal by the detector section, wherein the detector section detects a presence of an object in an inner flow passage of the isolation valve via detection of an interruption in the signal transmitted from an acoustic signal transmitter to an acoustic signal receiver, the interruption being caused by the presence of the object in the inner flow passage.

* * * * *